US009873983B2

(12) United States Patent
Zhu et al.

(10) Patent No.: US 9,873,983 B2
(45) **Date of Patent: *Jan. 23, 2018**

(54) PROCESS AND COMPOSITIONS FOR PAPER-MAKING

(71) Applicant: Ecolab USA Inc., St. Paul, MN (US)

(72) Inventors: Bo Zhu, Shenyang (CN); Meng Zhang, Shanghai (CN); Jun Li, Hebei (CN); Na Xu, Shanghai (CN); Yulin Zhao, Shanghai (CN)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/021,479

(22) PCT Filed: Sep. 12, 2014

(86) PCT No.: PCT/US2014/055409

§ 371 (c)(1),
(2) Date: Mar. 11, 2016

(87) PCT Pub. No.: WO2015/038901

PCT Pub. Date: Mar. 19, 2015

(65) Prior Publication Data

US 2016/0222590 A1 Aug. 4, 2016

(30) Foreign Application Priority Data

Sep. 12, 2013 (CN) ..... 2013 1 0413052

(51) Int. Cl.
*D21H 21/20* (2006.01)
*D21H 17/37* (2006.01)

(52) U.S. Cl.
CPC ..... *D21H 17/375* (2013.01); *D21H 17/37* (2013.01); *D21H 21/20* (2013.01)

(58) Field of Classification Search
CPC ..... D21H 21/20; D21H 17/37; D21H 17/375
USPC ..... 162/164.6
See application file for complete search history.

(56) References Cited

U.S. PATENT DOCUMENTS

| | | | |
|---|---|---|---|
| 3,556,932 A | 1/1971 | Coscia et al. | |
| 4,251,651 A | 2/1981 | Kawakami et al. | |
| 4,605,702 A | 8/1986 | Guerro et al. | |
| 5,674,362 A | 10/1997 | Underwood et al. | |
| 5,783,041 A | 7/1998 | Underwood | |
| 5,981,044 A | 11/1999 | Phan et al. | |
| 6,179,962 B1 | 1/2001 | Brady et al. | |
| 6,245,874 B1 | 6/2001 | Staib et al. | |
| 6,294,645 B1 | 9/2001 | Allen et al. | |
| 6,723,204 B2 | 4/2004 | Van Handel et al. | |
| 6,824,650 B2 | 11/2004 | Lindsay et al. | |
| 7,641,766 B2 | 1/2010 | St. John et al. | |
| 7,767,059 B2 | 8/2010 | Ryan et al. | |
| 7,883,603 B2 | 2/2011 | Hund et al. | |
| 7,897,013 B2 | 3/2011 | Hagiopol et al. | |
| 7,901,543 B2 | 3/2011 | St. John et al. | |
| 7,972,478 B2 | 7/2011 | Hund et al. | |
| 2006/0037727 A1* | 2/2006 | Hagiopol | C08F 220/56 162/168.3 |
| 2006/0065380 A1 | 3/2006 | Garnier et al. | |
| 2008/0216979 A1 | 9/2008 | Schaffer | |
| 2010/0190948 A1 | 7/2010 | Proverb et al. | |
| 2011/0155339 A1 | 6/2011 | Brungardt et al. | |
| 2012/0103548 A1 | 5/2012 | Zhao et al. | |
| 2012/0118523 A1 | 5/2012 | Lu et al. | |
| 2012/0186764 A1 | 7/2012 | McKay | |
| 2013/0081771 A1 | 4/2013 | Luo et al. | |
| 2016/0230346 A1* | 8/2016 | Zhu | D21H 21/18 |

FOREIGN PATENT DOCUMENTS

| | | |
|---|---|---|
| CA | 2690863 A1 | 12/2008 |
| CN | 101778873 A | 7/2010 |
| CN | 102050915 A | 5/2011 |
| EP | 0678528 A1 | 10/1995 |
| EP | 1456472 A1 | 9/2004 |
| JP | 54-30913 A | 3/1979 |
| JP | 58-4898 A | 1/1983 |
| JP | 1-49839 B2 | 10/1989 |
| JP | 2-307998 A | 12/1990 |
| JP | 2934284 B2 | 8/1996 |
| JP | 9-105097 A | 4/1997 |
| JP | 2001-279595 A | 10/2001 |
| JP | 2001-279599 A | 10/2001 |
| JP | 3273534 B2 | 4/2002 |
| JP | 2003-73991 A | 3/2003 |
| JP | 2004-11059 A | 1/2004 |
| JP | 2004-300629 A | 10/2004 |
| JP | 2005-15975 A | 1/2005 |
| JP | 2005-154966 A | 6/2005 |
| JP | 2005-226200 A | 8/2005 |
| JP | 2005-336646 A | 12/2005 |
| JP | 2006-138029 A | 6/2006 |
| JP | 2007-126770 A | 5/2007 |
| JP | 2007-126771 A | 5/2007 |
| JP | 2007-126772 A | 5/2007 |
| JP | 4352587 B2 | 10/2009 |
| JP | 4556191 B2 | 10/2010 |
| WO | WO 96/38629 A1 | 12/1996 |
| WO | WO 97/13033 A1 | 4/1997 |
| WO | WO 97/39189 A1 | 10/1997 |
| WO | WO 98/06898 A1 | 2/1998 |
| WO | WO 98/45536 A1 | 10/1998 |
| WO | WO 99/05361 A1 | 2/1999 |

(Continued)

OTHER PUBLICATIONS

Korean Patent Office, International Search Report in International Patent Application No. PCT/US2014/055409, dated Dec. 23, 2014, 2 pp.

(Continued)

*Primary Examiner* — Mark Halpern
(74) *Attorney, Agent, or Firm* — Leydig, Voit & Mayer, Ltd.

(57) ABSTRACT

The invention provides a process for paper-making comprising adding to pulp slurry at least a first aqueous liquid and a second aqueous liquid so as to obtain a paper stock; forming the paper stock so as to obtain a wet paper web; pressing and draining the wet paper web so as to obtain a wet paper sheet; and drying the wet paper sheet so as to obtain a paper sheet. Correspondingly, the invention provides an aid composition for paper-making.

26 Claims, No Drawings

(56) References Cited

FOREIGN PATENT DOCUMENTS

| | | | |
|---|---|---|---|
| WO | WO 00/11046 | A1 | 3/2000 |
| WO | WO 03/052206 | A1 | 6/2003 |
| WO | WO 2004/061235 | A1 | 7/2004 |
| WO | WO 2006/056381 | A1 | 6/2006 |
| WO | WO 2007/104716 | A1 | 9/2007 |
| WO | WO 2009/059725 | A2 | 5/2009 |
| WO | WO 2009/059725 | A3 | 5/2009 |
| WO | WO 2009/138457 | A1 | 11/2009 |
| WO | WO 2010/020551 | A1 | 2/2010 |
| WO | WO 2010/059946 | A1 | 5/2010 |
| WO | WO 2010/089334 | A1 | 8/2010 |
| WO | WO 2010/145956 | A1 | 12/2010 |
| WO | WO 2011/048000 | A1 | 4/2011 |
| WO | WO 2011/090672 | A1 | 7/2011 |

OTHER PUBLICATIONS

Korean Patent Office, Written Opinion in International Patent Application No. PCT/US2014/055409, dated Dec. 23, 2014, 4 pp.
European Patent Office, Extended European Search Report in European Patent Application No. 14844476.3, dated Mar. 15, 2017, 5 pp.

* cited by examiner

PROCESS AND COMPOSITIONS FOR PAPER-MAKING

CROSS-REFERENCE TO RELATED APPLICATIONS

This application is a national phase application of International Patent Application No. PCT/US2014/055409, filed Sep. 12, 2014, which claims priority to Chinese Patent Application No. 201310413052.7, filed Sep. 12, 2013, both of which are incorporated by reference herein in their entireties for all purposes.

TECHNICAL FIELD

The invention relates to a field of paper-making process, in particular to a paper-making process and a related composition useful in enhancing temporary wet strength of paper.

BACKGROUND OF THE INVENTION

Chemical aids for paper play an important role in the sustainable development of the paper-making industry, and therefore attract extensive attention. Chemical aids in paper-making can be classified into processing aids and functional aids. One of the functional aids is the strength aids, including dry strength aids, wet strength aids and temporary wet strength aids, etc.

A polymer of glyoxylated polyacrylamides, GPAMs, is one of frequently used temporary wet strength aids, as well as one of frequently used dry strength aids (see, e.g., U.S. Pat. No. 3,556,932A, U.S. Pat. No. 4,605,702A, U.S. Pat. No. 5,674,362A, U.S. Pat. No. 6,245,874B1, WO0011046A1, U.S. Pat. No. 7,641,766B2 and U.S. Pat. No. 7,901,543B2).

GPAMs are provided mainly in the form of a polymer solution. Generally speaking, if having the same solid content in the polymer solution, GPAMs with a higher molecular weight can provide a better temporary wet strengthening effect. However, the higher the molecular weight, the easier the GPAMs become gelled, so that the shelf life of the polymer solution is shortened, limiting the practical application of the polymer solution in the paper-making process. In order to secure that the polymer solution has a suitable shelf-life, usually it is necessary to (1) reduce the solid content of GPAMs in the polymer solution, or (2) reduce the molecular weight of GPAMs. As for (1), it requires that the solid content of the GPAMs in the polymer solution remains constant, normally between 8 and 20 wt %, for the sake of production and transportation. As for (2), more GPAMs with a lower molecular weight are required to be added into the pulp, compared to the GPAM with the higher molecular weight, in order to realize a comparable temporary wet strengthening effect, which is obviously not economical. In particular, the GPAMs with a weight average molecular weight of from 100,000 to 300,000 Dalton, despite its longer shelf life, has no practical application in the industry due to its unsatisfactory strengthening effect.

Therefore, how to endow the GPAMs with a better temporary wet strengthening effect without increasing the dosage of the GPAMs is a problem to be resolved.

On the other hand, amphoretic polyacrylamides are one of the frequently used dry strength aids (see, e.g., JP1049839B), while they almost have no effect of increasing the temporary wet strength.

WO9806898A1 discloses a paper-making process, wherein cationic polymer selected from the group consisting of cationic starch and cationic wet strength resin, and amphoteric polyacrylamide-type polymer is added to the aqueous pulp slurry in order to increase the dry strength of paper, and wherein GPAM can be used as the cationic wet strength resin. Moreover, U.S. Pat. No. 6,294,645B1 discloses a dry-strength system for paper comprising PAE, amphoteric PAM and wet strength resin, wherein GPAM can be used as the cationic wet strength resin. However, the above prior art literatures neither disclose nor suggest the combination use of GPAM and the amphoteric PAM has an effect of increasing the temporary wet strength, not to mention disclose or suggest the influence of the molecular weights of GPAM and the amphoteric PAM as well as the selection of their ratios on the effect of increasing the temporary wet strength.

SUMMARY OF THE INVENTION

In order to resolve the above mentioned issues, the inventors have performed intensive and deep research, and completed the invention based on the following findings: the temporary wet strengthening effect of dialdehyde-modified polyacrylamide-type strengthening agent can be significantly improved by a combination use of the amphoteric polyacrylamide-type strengthening agent with a specific molecular weight and the dialdehyde-modified polyacrylamide-type strengthening agent with a specific molecular weight in a specific ratio. In particular, the inventor further found that although the dialdehyde-modified polyacrylamide-type strengthening agent with a weight average molecular weight of 100,000-300,000 Dalton is not applicable in the industry as it can not provide a satisfactory effect of increasing temporary wet strength when used only, it can provide a temporary wet strength enhancing effect which is acceptable in the industry when used in combination with the amphoteric polyacrylamide-type strengthening agent having a specific molecular weight, thus the advantage of the specific dialdehyde-modified polyacrylamide-type strengthening agent, i.e., a long shelf life, can be utilized in the industry.

That is, the invention provides a process for paper-making, comprising the steps of:

(a) providing a pulp slurry;

(b) adding to the pulp slurry at least a first aqueous liquid and a second aqueous liquid so as to obtain a paper stock;

(c) forming the paper stock obtained in the step (b) so as to obtain a wet paper web;

(d) pressing and draining the wet paper web obtained in the step (c) so as to obtain a wet paper sheet; and (e) drying the wet paper sheet obtained in the step (d) so as to obtain a paper sheet, wherein, the first aqueous liquid contains one or more dialdehyde-modified polyacrylamide-type strengthening agent(s) and water as medium, and the second aqueous liquid contains one or more amphoteric polyacrylamide-type strengthening agent(s) and water as medium;

the dialdehyde-modified polyacrylamide-type strengthening agent has a weight average molecular weight of 100,000-2,000,000 Dalton;

the amphoteric polyacrylamide-type strengthening agent has a weight average molecular weight of 100,000-10,000,000 Dalton; and the dialdehyde-modified polyacrylamide-type strengthening agent and the amphoteric polyacrylamide-type strengthening agent added in the step (b) have a weight ratio of 25:75-75:25.

The invention further provides an aid composition for paper-making comprising one or more cationic or anionic or amphoteric dialdehyde-modified polyacrylamide-type strengthening agent, one or more amphoteric polyacrylamide-type strengthening agent and water as medium;

wherein:

the dialdehyde-modified polyacrylamide-type strengthening agent has a weight average molecular weight of 100,000-2,000,000 Dalton;

the amphoteric polyacrylamide-type strengthening agent has a weight average molecular weight of 100,000-10,000,000 Dalton; and the dialdehyde-modified polyacrylamide-type strengthening agent and the amphoteric polyacrylamide-type strengthening agent added in the step (b) have a weight ratio of 25:75-75:25.

DETAILED DESCRIPTION OF THE INVENTION

In order to make the object, technical solutions and advantages of the embodiments of the invention more clear, the technical solutions of the embodiments of the present invention are clearly and completely described below in the embodiments of the present invention. The embodiments described are merely some, rather than all embodiments of the present invention.

The invention first provides a process for paper-making comprising the steps of:

(a) providing a pulp slurry;

(b) adding to the pulp slurry at least a first aqueous liquid and a second aqueous liquid so as to obtain a paper stock;

(c) forming the paper stock obtained in the step (b) so as to obtain a wet paper web;

(d) pressing and draining the wet paper web obtained in the step (c) so as to obtain a wet paper sheet; and (e) drying the wet paper sheet obtained in the step (d) so as to obtain a paper sheet.

In the context, "paper-making process" or "process for paper-making" means a method of making paper products from pulp comprising forming an aqueous cellulosic paper-making furnish, draining the furnish to form a sheet and drying the sheet.

In the context, "pulp slurry" or "pulp" is intended to mean a product obtained from a pulping process. "Pulping" involves a production process of dissociating the plant fiber raw materials by a chemical method or a mechanical method, or a combination of the both, to form a paper pulp with an inherent color (unbleached pulp) or further to form a bleached pulp. The pulp can be any known pulp, including but not limited to, mechanical pulp, chemical pulp, chemical mechanical pulp, recycled waste paper pulp, for example a pulp containing recycled fiber.

In the context, the pulp is subject to the pulping and additive adjustment, producing a fiber suspension which can be used in hand sheet. Such fiber suspension is called as "paper stock", so as to be distinguished from the paper slurry which is not subject to a pulping and an additive adjustment.

In the context, "wet paper sheet" refers to a product obtained after the pulp stock passed the headbox, the forming section and the press section to be formed and partially drained, wherein the dryness of the wet paper sheet can be in a range of from 35% to 50%. For the sake of clarity, the product which comes from the forming section but is not subject to draining in the press section is called as "wet paper web", which can have a dryness in a range of from 15% to 25%.

In the context, "paper sheet" refers to a product obtained after the wet paper sheet is dried in the dryer section. The dryness of the paper sheet can be in a range of from 92% to 97%.

The paper-making process according to the invention can be carried out by the following procedure, but not limited to this, i.e., the paper-making process according to the invention can be also carried out by other known paper-making procedures in the art.

In the paper-making process, the paper slurry provided by a paper stock preparation system is generally subject to a slurry supply system (undergoing a treatment before the paper stock flows onto the wire), the headbox and the forming section, the press section, dryer section, etc.

1. The treatment before the paper stock flowing onto the wire comprises:

(1) the preparation of paper stock: the paper slurry can be made into a paper stock, and the preparation of the paper stock comprises pulping and additive adjustment (adding additives such as sizings, fillers, pigments and aids). The paper slurry is first subject to pulping wherein the fiber of the paper slurry undergoes treatments such as necessary cutting, swelling and fine fibrosis, so as to render the paper having physical properties and mechanical properties required by a certain sort of paper and meeting the requirements of a paper-making machine. In order to render the paper sheet useful for writing and resistant to liquid impregnation, improve the paper color, white and tone, increase the transparency of the paper and increase the printing performance of the paper, etc., the paper slurry can undergo sizing, adding filler and staining. Furthermore, various chemical aids can be added to provide the paper with some special properties (for example, enhancing the dry strength, wet strength and eliminating bubbles). For example, the first aqueous liquid and the second aqueous liquid can be added in this process.

(2) supplying the paper stock to the slurry supply system: the paper stock is supplied into the slurry supply system, undergoes treatments such as storing, screening, purifying, de-slagging, de-sanding, de-gassing, and discharges the metal, nonmetal impurities, fiber bundle, lump and air, etc., so as to avoid the adverse effect on the quality of the paper and hinder the paper-making process. The slurry pass undergoes slurry proportion, dilution, concentration adjustment, dosage and pressure elimination, and then flow into the head box and onto the wire for making paper.

2. The paper-making of paper comprises:

(1) stock flow approaching: the paper stock is delivered to the forming section (wire section) through the headbox. The headbox is useful in dispersing the fiber homogeneously and flowing the slurry onto the wire smoothly. The additives for paper making, such as the dry strength aids for paper, the wet strength aids for paper, can be added in the process of stock flow approaching. Preferably, the first aqueous liquid and the second aqueous liquid can be added in the process of stock flow approaching.

(2) forming: in the forming section, the paper stock delivered by the forming section is formed into a wet paper web by draining on the wire. The forming section is also referred to as wire section. The dryness of the wet paper web can be in range of from 15% to 25%. The step (c) is preferably performed by this step.

(3) pressing and draining: in the pressing section, the wet paper web from the forming section is subject to a mechanical pressing to form a wet paper sheet. The dryness of the wet paper sheet can be in a range of from 35% to 50%. The step (d) is preferably performed by this step.

(4) drying: in the dryer section, the wet paper sheet from the dryer section is dried with a dry cylinder to form a paper sheet. The dryness of the paper sheet can be in a range of from 92% to 97%. The step (e) is preferably performed by this step.

Moreover, the paper sheet can undergo, as required, finishing procedures such as calendering, winding and cutting, paper-sorting or rewinding, packaging, etc., so as to produce the paper sheet in to a finished paper in the form of flat or roller. Additionally, in order to improve the quality of the paper sheet, surface sizing, coating and online soft calender or offline supercalender can be carried out in the dryer section.

The general paper making process can be referred to, for example, "Principles for pulp and paper-making technology" (Editor: Zhu Guan, Harbin Institute of Technology Press, Version 1, February 2008), "Introduction to Pulping and Paper-making" (Editor: Liu Zhong, China Light Industry Press, Version 1, January 2007).

First Aqueous Liquid

In the context, the first aqueous liquid contains one or more cationic or anionic or amphoteric dialdehyde-modified polyacrylamide-type strengthening agent(s) as active ingredient and water as medium.

In the context, the dialdehyde-modified polyacrylamide-type strengthening agent is a common functional aid for paper-making, which is prepared by modifying a base polymer of polyacrylamide type with a dialdehyde. The dialdehyde modified polymer acrylamide-type strengthening agents are usually used as dry strength enhancer while some of them can be used to endow the paper with wet strength and drainage properties.

The polyacrylamide-type base polymer can be cationic or anionic or amphoteric. Correspondingly, the dialdehyde-modified polyacrylamide-type strengthening agent is cationic or anionic or amphoteric. The cationic polyacrylamide-type base polymer is a copolymer of one or more acrylamide monomer(s) and one or more cationic monomer(s) (see, e.g., U.S. Pat. No. 7,641,766B2, U.S. Pat. No. 7,901,543B2). The anionic polyacrylamide-type base polymer is a copolymer of one or more acrylamide monomer(s) and one or more anionic monomer(s) (see, e.g., WO0011046A1). The amphoteric. polyacrylamide-type base polymer is a copolymer of one or more acrylamide monomer(s), one or more cationic monomer(s) and one or more anionic monomer(s) (see, e.g., WO0011046A1).

"Acrylamide monomer" means the monomer of formula

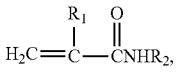

wherein $R_1$ is H or $C_1$-$C_4$ alkyl and $R_2$ is H, $C_1$-$C_4$ alkyl, aryl or arylalkyl. Acrylamide monomers can comprise acrylamide or methacrylamide, for example can be acrylamide.

"Alkyl" means a monovalent group derived from a straight or branched chain saturated hydrocarbon by the removal of a single hydrogen atom. Representative alkyl groups include methyl, ethyl, n- and iso-propyl, cetyl, and the like.

"Alkylene" means a divalent group derived from a straight or branched chain saturated hydrocarbon by the removal of two hydrogen atoms. Representative alkylene groups include methylene, ethylene, propylene, and the like.

"Aryl" means an aromatic monocyclic or multicyclic ring system of about 6 to about 10 carbon atoms. The aryl is optionally substituted with one or more $C_1$-$C_{20}$ alkyl, alkoxy or haloalkyl groups. Representative aryl groups include phenyl or naphthyl, or substituted phenyl or substituted naphthyl.

"Arylalkyl" means an aryl-alkylene-group where aryl and alkylene are defined herein. Representative arylalkyl groups include benzyl, phenylethyl, phenylpropyl, 1-naphthylmethyl, and the like, e.g., benzyl.

In non-limiting embodiments, the di-aldehyde is selected from glyoxal, malonaldehyde, succinic aldehyde and glutaraldehyde. For example, the di-aldehyde can be glyoxal.

In non-limiting embodiments, the cationic monomer can be one or two or more selected from a group consisting of diallyldimethylammonium chloride, N-(3-dimethylaminopropyl)methacrylamide, N-(3-dimethylaminopropyl) acrylamide, trimethyl-2-methacroyloxyethylammonium chloride, trimethyl-2-acroyloxyethylammonium chloride, methylacryloxyethyldimethyl benzyl ammonium chloride, acryloxyethyldimethyl benzyl ammonium chloride, (3-acrylamidopropyl)trimethylammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, and 2-(dimethylamino)ethyl acrylate. For example, the cationic monomer can be diallyldimethylammonium chloride (DADMAC).

In non-limiting embodiments, the anionic monomer can be one or two or more selected from a group consisting of acrylic acid, methacrylic acid, itaconic acid, maleic acid, and maleic anhydrid. For example, the anionic monomer can be acrylic acid, itaconic acid, a salt of acrylic acid, and/or a salt of itaconic acid.

There is no special limitation to the sum of the cationic monomers and/or the anionic monomers, as long as a stable polymer is prepared. For example, the sum of the cationic monomers and/or the anionic monomers can be 0.1-50 mol %, such as 1-20 mol %, of the copolymer, depending on the practical application.

There is no special limitation to the ratio of dialdehydes to acrylamide monomers in the dialdehyde modified polyacrylamide-type strengthening agent, and it can be 0.01:1-1:1 (molar ratio), for example, 0.1:1-0.8:1 (molar ratio).

There is no special limitation to the ratio of the cationic monomers to the anionic monomers in the dialdehyde modified polyacrylamide-type strengthening agent. For example, the molar ratio of the cationic monomers to the anionic monomers can be 1:100-100:1, e.g., 1:10-10:1, but without being limited to those.

In order to realize the technical effects of the invention, the weight average molecular weight of the dialdehyde modified polyacrylamide-type strengthening agent is critical, and can be 100,000-2,000,000 Dalton, e.g., 120,000-1,500,000 Dalton, or 200,000-1,200,000 Dalton, or 150,000-1,100,000 Dalton, or 200,000-1,000,000 Dalton. In addition, the weight average molecular weight of the dialdehyde modified polyacrylamide-type strengthening agent can be 100,000-300,000 Dalton, e.g., 150,000-300,000 Dalton, or 200,000-300,000 Dalton.

There is not special limitation to the solid content of the dialdehyde-modified polyacrylamide-type strengthening agent in the first aqueous liquid. Considering the availability and facility of the production and the operation, the solid content is preferably 0.1-50 wt %, e.g., 1-20 wt %, or e.g., 5-15 wt %.

The dialdehyde-modified polyacrylamide-type strengthening agent can be cationic dialdehyde-modified polyacrylamide-type strengthening agent. In some embodiments, the cationic dialdehyde-modified polyacrylamide-type strengthening agent is a copolymer of glyoxylated polyacrylamide and diallyldimethylammonium chloride (also called as GPAM/DADMAC copolymer), which is cationic. The GPAM/DADMAC copolymer can have a glyoxal to acrylamide monomer ratio (G/A ratio) 0.01:1-1:1 (molar ratio), e.g., 0.1:1-0.8:1 (molar ratio). Relative to 100 molar parts of total acrylamide and diallyldimethylammonium chloride constituting the GPAM/DADMAC copolymer, the acrylamide can be 75-99 molar parts, e.g., 85-95 molar parts, but without being limited to those. The GPAM/DADMAC copolymer can have a weight average molecular weight of 100,000-2,000,000 Dalton, e.g., 120,000-1,500,000 Dalton, or e.g., 200,000-1,200,000 Dalton, or e.g., 150,000-1,100,000 Dalton, or e.g., 200,000-1,000,000 Dalton. The GPAM/DADMAC copolymer can have a weight average molecular weight of 100,000-300,000 Dalton, e.g., 150,000-300,000 Dalton, e.g., 200,000-300,000 Dalton. There is not special limitation to the solid content of the GPAM/DADMAC copolymer in the first aqueous liquid. Considering the availability and facility of the production and the operation, the solid content is, for example, 0.01-50 wt %, e.g., 0.1-40 wt %, or e.g., 1-30 wt %, or e.g., 5-25 wt %.

The dialdehyde-modified polyacrylamide-type strengthening agent can be prepared according to the known technology, for example, referring to U.S. Pat. No. 7,641,766 B2 assigned to Nalco Co. As the commercially available dialdehyde-modified polyacrylamide-type strengthening agent, Nalco 64280, Nalco 64170, and Nalco 64180 can be named.

The first aqueous liquid may contain or may not contain the amphoteric polyacrylamide-type strengthening agent. From the view point of availability, for example, the first aqueous liquid does not contain the amphoteric polyacrylamide-type strengthening agent.

Optionally, the first aqueous liquid may contain or may not contain other chemical aids for paper-making, especially synthetic polymer aids for paper-making, e.g., polyvinyl alcohol (PVA), urea-formaldehyde resin, melamine formaldehyde resin, polyethyleneimine (PEI), polyethylene oxide (PEO), polyamide-epichlorohydrin resin (PAE), etc. Especially, as required, the first aqueous liquid may contain or may not contain other dry strength enhancers. In the case that the first aqueous liquid contains other chemical aids for paper-making, those skilled in the art can select the suitable kinds and amounts of the chemical aids for paper-making as required.

There is no special limitation to the preparation method of the first aqueous liquid. For example, the first aqueous liquid is prepared by mixing the dialdehyde-modified polyacrylamide-type strengthening agent(s), water as medium, and optional other components.

Second Aqueous Liquid

The second aqueous liquid contains one or more amphoteric polyacrylamide-type strengthening agent(s). In the context, the amphoteric polyacrylamide-type strengthening agents refer to common functional aids for paper-making, which is a copolymer of one or more acrylamide monomer(s), one or more cationic monomers type and one or more anionic monomers (see, e.g., WO0011046A1). The amphoteric polyacrylamide-type strengthening agents used as dry strength enhancer. As one of the most widely used dry strength enhancers, it has advantages in some aspects of providing good dry strength, high solid content and long shelf life, but it is well known that it can not provide temporary wet strength.

The definition and the exemplary examples of "acrylamide monomer" refer to the description in the above Part "the first aqueous liquid".

In order to realize the technical effects of the invention, the weight average molecular weight of the amphoteric polyacrylamide-type strengthening agent can be 100,000-10,000,000 Dalton, e.g., 500,000-2,000,000 Dalton, or 800,000-1,200,000 Dalton.

In non-limiting embodiments, the cationic monomer can be one or two or more selected from a group consisting of diallyldimethylammonium chloride, N-(3-dimethylaminopropyl)methacrylamide, N-(3-dimethylaminopropyl)acrylamide, trimethyl-2-methacroyloxyethylammonium chloride, trimethyl-2-acroyloxyethylammonium chloride, methylacryloxyethyldimethyl benzyl ammonium chloride, acryloxyethyldimethyl benzyl ammonium chloride, (3-acrylamidopropyl)trimethylammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, and 2-(dimethylamino)ethyl acrylate. For example, the cationic monomer can be diallyldimethylammonium chloride, N-(3-dimethylaminopropyl)acrylamide, trimethyl-2-acroyloxyethylammonium chloride or 2-(dimethylamino)ethyl methacrylate. In non-limiting embodiments, the anionic monomer can be one or two or more selected from a group consisting of acrylic acid, methacrylic acid, itaconic acid, maleic acid, and maleic anhydrid. For example, the anionic monomer can one or two or more selected from the group consisting of acrylic acid or itaconic acid, a salt of acrylic acid and a salt of itaconic acid.

There is no special limitation to the sum of the cationic monomers and/or the anionic monomers, as long as a stable polymer is prepared. For example, the sum of the cationic monomers and/or the anionic monomers can be 0.1-50 mol %, such as 1-20 mol %, of the copolymer, depending on the practical application. Moreover, there is no special limitation to the molar ratio of the cationic monomers to the anionic monomers in the amphoteric polyacrylamide. For example, the molar ratio of the cationic monomers to the anionic monomers can be 1:100-100:1, e.g., 5:1-2:1.

In non-limiting embodiments, the second aqueous liquid contains substantially 0% of an aldehyde that can be used as cross-linking agent. In the context, the aldehyde that can be used as cross-linking agent comprises di-aldehyde or poly-aldehyde (tri-aldehyde or more). In the context, "substantially 0% of an aldehyde that can be used as cross-linking agent" is intended to mean no deliberate addition of aldehyde that can be used as cross-linking agent.

The amphoteric polyacrylamide-type strengthening agent can be prepared according to the known technology, e.g., as described in JP54030913A, JP58004898A. It should be noted that, in the process of producing the dialdehyde-modified polyacrylamide-type strengthening agent, a cross-linking agent and/or a chain transfer agent can be used to provide a branched/cross-linked structure of the copolymer. As commercially available amphoteric polyacrylamide-type strengthening agents, Nalco 847 and Nalco 828 from Nalco Company, etc., can be named.

There is not special limitation to the solid content of the amphoteric polyacrylamide-type strengthening agent in the second aqueous liquid. Considering the availability and facility of the production and the operation, the solid content can be 0.01-50 wt %, e.g., 0.1-40 wt %, or e.g., 1-30 wt %, or e.g., 5-25 wt %.

The second aqueous liquid may contain or may not contain the dialdehyde-modified polyacrylamide-type strengthening agent. From the view of point of availability, for example, the second aqueous liquid does not contain the dialdehyde-modified polyacrylamide-type strengthening agent.

Optionally, the second aqueous liquid may contain or may not contain other chemical aids for paper-making, especially synthetic polymer aids for paper-making, e.g., polyvinyl alcohol (PVA), urea-formaldehyde resin, melamine formaldehyde resin, polyethyleneimine (PEI), polyethylene oxide (PEO), polyamide-epichlorohydrin resin (PAE), etc. Especially, as required, the second aqueous liquid may contain or may not contain other dry strength enhancers. In the case that the second aqueous liquid contains other chemical aids for paper-making, those skilled in the art can select the suitable kinds and amounts of the chemical aids for paper-making as required.

There is no special limitation to the preparation method of the second aqueous liquid. For example, the second aqueous liquid is prepared by mixing the amphoretic polyacrylamide-type strengthening agent(s), water as medium, and optional other components.

It should be further noted that, the first aqueous liquid and the second aqueous liquid can be in the form of solution or dispersion.

Water as Medium

There is no special limitation to the water used as medium, as long as it satisfies the requirements of a medium used for paper-making aids. For example, tap water, distilled water, deionized water, ultrapure water can be used.

Addition Step

In the addition step (b), the addition of the first aqueous liquid and the second aqueous liquid can be carried out in any sequence or simultaneously, or the first aqueous liquid and the second aqueous liquid is mixed to form a mixture prior to the addition to the mixture into the pulp slurry.

In order to realize the technical effects of the invention, the addition ratio of the first aqueous liquid and the second aqueous liquid is critical. The first aqueous liquid and the second aqueous liquid can be added in a ratio of 25:75-75:25 (weight ratio), e.g., 30:70-70:30 (weight ratio), e.g., 40:60-60:40 (weight ratio), e.g., 1:1 (weight ratio), calculated based on the active ingredients.

The first aqueous liquid and the second aqueous liquid is added in an amount of about 0.1 kg/ton dry fibre to about 50 kg/ton dry fibre, based on the weight ratio of the sum of the active ingredients relative to the dry fibre in the pulp slurry, thereby advantageously enhancing the temporary wet strength. For example, the dosage can be about 1 kg/ton dry fibre to about 10 kg/ton dry fibre, e.g., about 1 kg/ton dry fibre to about 10 kg/ton dry fibre e.g., about 3 kg/ton dry fibre to about 6 kg/ton dry fibre, depending on the specific paper-making environment (for example, the used paper-making machine and the starting materials for the paper-making machine) as well as the requirements of the paper strength properties.

The first aqueous liquid and the second aqueous liquid can be packaged in different and separate container, such as tank truck, tank, bucket, bottle, bag. When in use, the user can formulate or dose these two aqueous liquids to the desired concentrations and solid contents according to the practical application. The first aqueous liquid and the second aqueous liquid can be stored on site at the paper-making plant for a long term and ready to use after prepared at another place. Moreover, these liquids can be prepared immediately before use.

The process according to the invention can be easily and conveniently incorporated into the existing paper-making equipment without any modification to the equipment.

Aid Composition for Paper-Making

The invention further provides an aid composition for paper-making comprising one or more cationic or anionic or amphoteric dialdehyde-modified polyacrylamide-type strengthening agent and one or more amphoteric polyacrylamide-type strengthening agent as active ingredients, and comprising water as medium. Herein, "dialdehyde-modified polyacrylamide-type strengthening agent" is the same as the dialdehyde-modified polyacrylamide-type strengthening agent described in the above section "first aqueous liquids". "Amphoteric polyacrylamide-type strengthening agent" is the same as the amphoteric polyacrylamide-type strengthening agent described in the above section "second aqueous liquids". "Water as medium" is the same as described in the above section "water as mediums".

In order to realize the technical effects of the invention, the ratio of the first aqueous liquid and the second aqueous liquid in the aid composition for paper-making is critical, which can be 25:75-75:25, e.g., 30:70-70:30, e.g., 40:60-60:40, e.g., 1:1.

There is not special limitation to the solid content of the dialdehyde-modified polyacrylamide-type strengthening agent in the aid composition for paper-making. Considering the availability and facility of the production and the operation, the solid content can be 0.01-50 wt %, e.g., 0.1-40 wt %, or e.g., 1-30 wt %, or e.g., 5-25 wt %.

There is not special limitation to the solid content of the amphoteric polyacrylamide-type strengthening agent. Considering the availability and facility of the production and the operation, the solid content can be 0.01-60 wt %, e.g., 0.1-40 wt %, or e.g., 1-30 wt %, or e.g., 5-25 wt %.

There is not special limitation to the total solid content of the dialdehyde-modified polyacrylamide-type strengthening agent and the amphoteric polyacrylamide-type strengthening agent in the aid composition for paper-making. Considering the availability and facility of the production and the operation, the total solid content can be 0.01-60 wt %, e.g., 0.1-40 wt %, or e.g., 1-30 wt %, or e.g., 5-25 wt %.

In non-limiting embodiments, the aid composition for paper-making contains substantially 0% of an aldehyde that can be used as cross-linking agent.

Optionally, the aid composition for paper-making may contain or may not contain other chemical aids for paper-making, especially synthetic polymer aids for paper-making, e.g., polyvinyl alcohol (PVA), urea-formaldehyde resin, melamine formaldehyde resin, polyethyleneimine (PEI), polyethylene oxide (PEO), polyamide-epichlorohydrin resin (PAE), etc. Especially, as required, the aid composition for paper-making may contain or may not contain other dry strength enhancers. In the case that the second aqueous liquid contains other chemical aids for paper-making, those skilled in the art can select the suitable kinds and amounts of the chemical aids for paper-making as required.

There is no special limitation to the preparation method of the aid composition for paper-making. For example, the aid composition for paper-making can be prepared by mixing the dialdehyde-modified polyacrylamide-type strengthening agent, the amphoteric polyacrylamide-type strengthening agent, water as medium, and optional other components. Alternatively, the aid composition for paper-making can be prepared by first mixing the dialdehyde-modified polyacrylamide-type strengthening agent, the amphoteric polyacrylamide-type strengthening agent and optional other components separately with the water as medium, and then mixing the resulting various liquids together (e.g., mixing the first aqueous liquid and the second aqueous liquid described above).

Furthermore, it should be noted that, the aid composition for paper-making can be in the form of solution or dispersion.

The process for paper-making according to the invention and the aid composition for paper-making according to the invention can be used to prepare all types of paper, such as package paper, tissue, fine paper, etc. The process for paper-making according to the invention and the aid composition for paper-making according to the invention are especially suitable for the preparation of fine paper and tissue which have high requirements on the temporary wet strength.

EXAMPLES

1. Paper-Making Process and Characterization of Paper (a) Method for Making Hand Sheet The pulp slurry (thick stock) is obtained directly from a paper mill. The thick stock contains 100% COCC and has an electrical conductivity of about 2.5-3.6 ms/cm. Sheet-making is performed after the thick stock is diluted with tape water or white water from paper-making plant to a concentration of about 0.7%. The electrical conductivity is controlled at about 3 ms/cm during the whole sheet-making process.

Semi-automatic Tappi standard sheet-making machine, provided by FRANK-PTI Co., is used as sheet-making machine. The specific test method is described in T205 Introduction sp-02. To the diluted pulp, 15 kg/ton of 50 wt aqueous aluminum sulfate solution, test additives (its dosage is 3 kg/ton or 6 kg/ton, calculated as active ingredient), dual retention aid (0.2 kg/ton of Nalco 61067 and 2 kg/ton of bentonite) are added successively at a rotation speed of 800 rpm in a addition interval of 15 seconds.

The pulp added with the agents is poured into a forming cylinder of paper-making machine and undergoes filtering and forming. Afterwards, the forming cylinder is opened, and a bibulous paper is taken to cover the wet paper sheet which is then covered with a flat clamp to remove part of water. Then the paper sample is transferred to a new bibulous paper which is then covered with stainless steel clamp, onto which a bibulous paper is covered again, the wet paper sample is thus accumulated. When accumulating 5 to 10 paper samples, they are provided in to a special press machine to perform a two-section pressing, further removing water from paper.

The pressed paper is transferred to a constant temperature and humidity lab (50% humidity at 23° C.), and every single paper sample is placed into a special metal ring. Piling up the metal rings and placing a heavy object onto the metal ring where the paper sample lies on. After air drying for 24 hours, the paper sample can be peeled successively from stainless steel clamp for corresponding test.

(b) Test Method for Dry Tensile Index

Tensile index refers to the maximum force that paper or paperboard can withstand at a specified condition. The specification is described in Tappi 494 om-06 standard. A paper sample is cut out with a width of 15 mm and a length of larger than 15 cm.

A L&W Horizontal Tensile Tester is used in the experiment. The pressure of the tester is set to 2 kg. The cut paper sample is placed between two clamps of the tester. The tester will stretch automatically the paper sample until it is broken. Read the maximum tensile value shown on the display, expressed as N. The dry tensile index is calculated as follows:

$$Y=F/(L\cdot g)\times 1000$$

Y—tensile index, N·m/g

F—tensile force, N

L—width of the test paper sample, mm g—paper basis weight, g/m$^2$ (c) Test Method for Burst Index Burst index refers to maximum pressure on a unit area that paper or paperboard can withstand, normally expressed as kPa.

A L&W burst tester is used in this experiment. The pressure of the tester is controlled as 5 kg. After the paper is inserted into a test tank, the test button is pressed and the glass cover is automatically lowered down. On a LED display is shown the maximum pressure value (kPa) when the paper is torn.

The burst index is calculated as follows:

$$X=p/g$$

X—Burst index, kPa·m$^2$/g p—burst, kPa g—paper basis weight, g/m$^2$ (d) Test Method for Temporary Wet Tensile Index KZW-300 Microcomputer-controlled Tensile Test Machine from Changchun paper testing machine factory is used in this experiment.

A paper sample is cut out with a width of 15 mm and a length of larger than 15 cm. A sponge is provided and completely soaked in water. The cut paper sample is pressed onto the wet sponge for one second (1 s) each side, and then the sample is immediately held between the two clamps of the test machine. The test is started and the strength at break is recorded, expressed as N.

The temporary wet tensile index is calculated as follows:

$$Y=F/(L\cdot g)\times 1000$$

Y—temporary wet tensile index, N·m/g

F—tensile force, N

L—width of the test paper sample, mm g—paper basis weight, g/m$^2$.

(e) Shelf-Life Test

The sample to be tested was placed in an oven at a constant temperature of 40° C. Small samples were taken out daily for the determination of viscosity after being cooled to room temperature (25° C.) until the Sample was gelled.

(f) Determination of Viscosity

Brookfield Programmable LVDV-II+viscometer, manufactured by Brookfield Engineering Laboratories, Inc, Middleboro, Mass., is utilized in this experiment.

0-100 cps, measured by Spindle 1 at 60 rpm 100-1000 cps, measured by Spindle 2 at 30 rpm 1000-10000 cps, measured by Spindle 3 at 12 rpm 2. Polyacrylamide-Type Dry Strength Aid The amphoteric polyacrylamide-type dry strengthening agents used in the Examples and Comparative Examples were prepared as follows:

(1). Synthesis of Amphoteric Polyacrylamide Copolymer 1

To 2 L reactor, 277 g acrylamide (with a concentration of 40%), 333 g soft water, 6 g itaconic acid, 35 g acryloxyethyldimethyl benzyl ammonium chloride (with a concentration of 80%), 5 g 2-(dimethylamino)ethyl methacrylate, 3 g concentrated hydrochloric acid, 130 g soft water were successively added and stirred to be homogeneous prior to be purged with nitrogen gas. Thirty minutes later, 7 g 0.45 wt % aqueous solution of N,N-methylene biacrylamide was added. Afterwards, 1.2 g 4.3 wt % aqueous solution of ammonium persulfate and 2.4 g 7.5 wt % aqueous solution of sodium bisulfite were added. Nitrogen gas was purged until the temperature increased 1.5° C. After the temperature was increased to 70° C., the reaction was maintained at this temperature for 6 hours until the reaction was completed. 1.8 g a 5.6 wt % aqueous solution of oxalic acid and 199 g soft water were added with stirring. Continuing stirring for 1 hour to obtain the amphoteric polyacrylamide copolymer 1 with a solid content of 15 wt %, a viscosity of about 5000 cps, a molecular weight of 1,000,000 Dalton.

(2). Synthesis of Amphoteric Polyacrylamide Copolymer 2

To 2 L reactor, 297 g acrylamide (with a concentration of 40%), 323 g soft water, 6 g itaconic acid, 25 g acryloxyethyldimethyl benzyl ammonium chloride (with a concentration of 80%), 6 g 2-(dimethylamino)ethyl methacrylate, 3 g concentrated hydrochloric acid, 130 g soft water were successively added, and stirred to be homogeneous prior to be purged with nitrogen gas. Thirty minutes later, 7 g 0.45 wt % aqueous solution of N,N-methylene biacrylamide was added. Afterwards, 1.2 g 4.3 wt % aqueous solution of ammonium persulfate and 2.4 g 7.5 wt % aqueous solution of sodium bisulfite were added. Nitrogen gas was purged until the temperature increased 1.5° C. After the temperature was increased to 70° C., the reaction was maintained at this temperature for 6 hours until the reaction was completed. 1.8 g 5.6 wt % aqueous solution of oxalic acid and 199 g soft water were added with stirring. Continuing stirring for 1 hour to obtain the amphoteric polyacrylamide copolymer 2 with a solid content of 15 wt %, a viscosity of about 5000 cps, a molecular weight of 1,100,000 Dalton.

3. Glyoxylated Polyacrylamide-Type Dry Strengthening Agent (GPAM Copolymer Solution)

The GPAMs used in the examples were prepared as follows.

(1). Synthesis of Base Polymer 1 (Intermediate 1)

To a 2 L three-neck flask with a heating and a cooling tube, 90 g soft water, 0.1 g ethylenediamine tetraacetic acid (EDTA) and 160 g diallyldimethylammonium chloride (DADMAC) were added. An initiator comprising 4 g ammonium persulfate and 16 g soft water was added once the obtained solution was heated to 100° C. and the addition took 137 minutes to complete. The addition of monomer phase containing 625 g acrylamide (concentration 50%) was started after adding the initiator for 2 minutes. The addition of monomer phase took 120 minutes to complete. After completing the addition of the initiator, the solution was incubated at 100° C. The reaction ended in 1 hour, affording an intermediate with a solid content of 41 wt % and a viscosity of 2000 cps.

(2). Synthesis of Base Polymer 2 (Intermediate 2)

To a 2 L three-neck flask with a heating and a cooling tube, 90 g soft water, 0.1 g ethylenediamine tetraacetic acid (EDTA) and 64 g diallyldimethylammonium Chloride (DADMAC) were added. An initiator comprising 4 g ammonium persulfate and 16 g soft water was added once the obtained solution was heated to 100° C. and the addition took 137 minutes to complete. The addition of monomer phase containing 743 g acrylamide (concentration 50%) was started after adding the initiator for 2 minutes. The addition of monomer phase took 120 minutes to complete. After completing the addition of the initiator, the solution was incubated at 100° C. The reaction ended in 1 hour, affording an intermediate with a solid content of 41 wt % and a viscosity of 1000 cps.

(3). Synthesis of Glyoxylated Polyacrylamide-Type Copolymer 1 (GPAM Copolymer Solution 1)

To a 2 L glass container, 630 g soft water, 300 g the above base polymer 1 and 70 g 40% solution of glyoxal were separately added and mixed at 25° C. for 15 minutes. The pH value of the obtained solution was adjusted to 7.5 with a 48% sodium hydroxide solution. During the reaction, samples were taken for the determination of the viscosity until a product with a viscosity of 13.3 cps was obtained. The obtained product was adjusted with a 50% sulfuric acid until pH value is 3, affording a polymer having a solid content of 15 wt % and a molecular weight of 150,000 Dalton. The final product was marked with "GPAM copolymer solution 1".

(4). Synthesis of Glyoxylated Polyacrylamide-Type Copolymer 2 (GPAM Copolymer Solution 2)

To a 2 L glass container, 630 g soft water, 300 g the above base polymer 1 and 70 g 40% solution of glyoxal were separately added and mixed at 25° C. for 15 minutes. The pH value of the obtained solution was adjusted to 7.5 with a 48% sodium hydroxide solution. During the reaction, samples were taken for the determination of the viscosity until a product with a viscosity of 14.8 cps was obtained. The obtained product was adjusted with a 50% sulfuric acid until pH value is 3, affording a polymer having a solid content of 15 wt % and a molecular weight of 200,000 Dalton. The final product was marked with "GPAM copolymer solution 2".

(5). Synthesis of Glyoxylated Polyacrylamide-Type Copolymer 3 (GPAM Copolymer Solution 3)

To a 2 L glass container, 630 g soft water, 300 g the above base polymer 1 and 70 g 40% solution of glyoxal were separately added and mixed at 25° C. for 15 minutes. The pH value of the obtained solution was adjusted to 7.5 with a 48% sodium hydroxide solution. During the reaction, samples were taken for the determination of the viscosity until a product with a viscosity of 31.1 cps was obtained. The obtained product was adjusted with a 50% sulfuric acid until pH value is 3, affording a polymer having a solid content of 15 wt % and a molecular weight of 800,000 Dalton. The final product was marked with "GPAM copolymer solution 3."

(6). Synthesis of Glyoxylated Polyacrylamide-Type Copolymer 4 (GPAM Copolymer Solution 4)

To a 2 L glass container, 605 g soft water, 341 g the above base polymer 2 and 26 g 40% solution of glyoxal were separately added and mixed at 25° C. for 15 minutes. The pH value of the obtained solution was adjusted to 8.4 with a 48% sodium hydroxide solution. During the reaction, samples were taken for the determination of the viscosity until a product with a viscosity of 32.2 cps was obtained. The obtained product was adjusted with a 50% sulfuric acid until pH value is 3, affording a polymer having a solid content of 15 wt % and a molecular weight of 1,000,000 Dalton. The final product was marked with "GPAM copolymer solution 4".

Shelf-Life Example

The shelf-life of GPAM copolymer solutions 2 and 3 at 40° C. were tested according to the above test method for shelf-life. The results are shown in the following table:

| | Gelation time at 40° C. |
|---|---|
| GPAM copolymer solution 2 | 10 days |
| GPAM copolymer solution 3 | Less than 5 days |

It can be seen from the above table that GPAM copolymer solution 2 shows a longer shelf life at 40° C., which corresponds to a shelf life of 2-3 months at 25° C., while GPAM copolymer solution 3 can be stored at 25° C. for about 10 days.

Example 1

GPAM copolymer solution 1 was pre-mixed with the amphoteric polyacrylamide copolymer 1 in a ratio of 1:1 (w/t) to obtain Combination 1. The resulting Combination 1 was used as test additive in two dosages (3 kg/ton or 6 kg/ton) in the preparation of the hand sheet samples 1A and 1B of the invention according to the hand sheet preparation method described above. The thick stock used in the Example was recycled waste paper pulp. In the Example, 15 kg/ton of 50 wt % aqueous aluminum sulfate solution was used as fixing agent, and a dual retention aid (0.2 kg/ton of Nalco 61067 and 2.0 kg/ton of bentonite) was used as retention aid.

It should be noted that the dosage herein refers to the amount of the active ingredient in the solution (agent) relative to the dry fiber in the pulp slurry.

Example 2

GPAM copolymer solution 1 was pre-mixed with the amphoteric polyacrylamide copolymer 1 in a ratio of 3:1 (w/t) to obtain Combination 2. The resulting Combination 2 was used as test additive in two dosages (3 kg/ton or 6 kg/ton) in the preparation of the hand sheet samples 2A and 2B of the invention according to the hand sheet preparation method described above. The thick stock used in the Example was recycled waste paper pulp. In the Example, 15 kg/ton of 50 wt % aqueous aluminum sulfate solution was used as fixing agent, and a dual retention aid (0.2 kg/ton of Nalco 61067 and 2.0 kg/ton of bentonite) was used as retention aid.

Example 3

GPAM copolymer solution 1 was pre-mixed with the amphoteric polyacrylamide copolymer 1 in a ratio of 1:3 (w/t) to obtain Combination 3. The resulting Combination 3 was used as test additive in two dosages (3 kg/ton or 6 kg/ton) in the preparation of the hand sheet samples 3A and 3B of the invention according to the hand sheet preparation method described above. The thick stock used in the Example was recycled waste paper pulp. In the Example, 15 kg/ton of 50 wt % aqueous aluminum sulfate solution was used as fixing agent, and a dual retention aid (0.2 kg/ton of Nalco 61067 and 2.0 kg/ton of bentonite) was used as retention aid.

Example 4

GPAM copolymer solution 2 was pre-mixed with the amphoteric polyacrylamide copolymer 1 in a ratio of 1:1 (w/t) to obtain Combination 4. The resulting Combination 4 was used as test additive in two dosages (3 kg/ton or 6 kg/ton) in the preparation of the hand sheet samples 4A and 4B of the invention according to the hand sheet preparation method described above. The thick stock used in the Example was recycled waste paper pulp. In the Example, 15 kg/ton of 50 wt % aqueous aluminum sulfate solution was used as fixing agent, and a dual retention aid (0.2 kg/ton of Nalco 61067 and 2.0 kg/ton of bentonite) was used as retention aid.

Example 5

In the above preparation method of hand sheet, equal amounts of GPAM copolymer solution 2 and the amphoteric polyacrylamide copolymer 1 were added simultaneously into the pulp slurry to prepare hand sheet samples 5A and 5B. GPAM copolymer solution 2 and the amphoteric polyacrylamide copolymer 1 are added into the pulp slurry in a dosage of 1.5 kg/ton (Hand sheet sample 5A) or 3 kg/ton (Hand sheet sample 5B), respectively, i.e., the sum of the two additives is 3 kg/ton or 6 kg/ton. In the Example, 15 kg/ton of 50 wt % aqueous aluminum sulfate solution was used as fixing agent, and dual retention aid (0.2 kg/ton of Nalco 61067 and 2.0 kg/ton of bentonite) was used as retention aid.

Example 6

GPAM copolymer solution 3 was pre-mixed with the amphoteric polyacrylamide copolymer 1 in a ratio of 1:1 (w/t) to obtain Combination 5. The resulting Combination 5 was used as test additive in two dosages (3 kg/ton or 6 kg/ton) in the preparation of the hand sheet samples 6A and 6B of the invention according to the hand sheet preparation method described above. In the Example, 15 kg/ton of 50 wt % aqueous aluminum sulfate solution was used as fixing agent, and dual retention aid (0.2 kg/ton of Nalco 61067 and 2.0 kg/ton of bentonite) was used as retention aid.

Example 7

In the above preparation method of hand sheet, equal amounts of GPAM copolymer solution 3 and the amphoteric polyacrylamide copolymer 1 were added simultaneously into the pulp slurry to prepare hand sheet samples 7A and 7B. GPAM copolymer solution 3 and the amphoteric polyacrylamide copolymer 1 are added into the pulp slurry in a dosage of 3 kg/ton (Hand sheet sample 7A) or 3 kg/ton (Hand sheet sample 7B), respectively, i.e., the sum of the two additives is 3 kg/ton or 6 kg/ton. In the Example, 15 kg/ton of 50 wt % aqueous aluminum sulfate solution was used as fixing agent, and dual retention aid (0.2 kg/ton of Nalco 61067 and 2.0 kg/ton of bentonite) was used as retention aid.

Example 8

GPAM copolymer solution 4 was pre-mixed with the amphoteric polyacrylamide copolymer 2 in a ratio of 1:1 (w/t) to obtain Combination 6. The resulting Combination 6 was used as test additive in two dosages (1 kg/ton or 2 kg/ton or 4 kg/ton) in the preparation of the hand sheet samples 8A, 8B and 8C of the invention according to the hand sheet preparation method described above. In the Example, 15 kg/ton of 50 wt % aqueous aluminum sulfate solution was used as fixing agent, and dual retention aid (0.4 kg/ton of Nalco 61067 and 2.0 kg/ton of bentonite) was used as retention aid.

Comparative Example 1

GPAM copolymer solution 1 was used as only test additive in two dosages relative to the pulp slurry (3 kg/ton or 6 kg/ton) to prepare comparative hand sheet samples 1a and 1b according to the hand sheet preparation method. The thick stock used in the Example was recycled waste paper pulp. In the Example, 15 kg/ton of 50 wt % aqueous aluminum sulfate solution was used as fixing agent, and dual retention aid (0.2 kg/ton of Nalco 61067 and 2.0 kg/ton of bentonite) was used as retention aid.

Comparative Example 2

GPAM copolymer solution 2 was used as only test additive in two dosages relative to the pulp slurry (3 kg/ton or 6 kg/ton) to prepare comparative hand sheet samples 2a and 2b according to the hand sheet preparation method. The thick stock used in the Example was recycled waste paper pulp. In the Example, 15 kg/ton of 50 wt % aqueous aluminum sulfate solution was used as fixing agent, and dual retention aid (0.2 kg/ton of Nalco 61067 and 2.0 kg/ton of bentonite) was used as retention aid.

Comparative Example 3

GPAM copolymer solution 3 was used as only test additive in two dosages relative to the pulp slurry (3 kg/ton or 6 kg/ton) to prepare comparative hand sheet samples 3a and 3b according to the hand sheet preparation method. The thick stock used in the Example was recycled waste paper pulp. In the Example, 15 kg/ton of 50 wt % aqueous aluminum sulfate solution was used as fixing agent, and dual retention aid (0.2 kg/ton of Nalco 61067 and 2.0 kg/ton of bentonite) was used as retention aid.

Comparative Example 4

Amphoteric Polyacrylamide Copolymer 1 was used as only test additive in two dosages relative to the pulp slurry (3 kg/ton or 6 kg/ton) to prepare comparative hand sheet samples 4a and 4b according to the hand sheet preparation method. The thick stock used in the Example was recycled waste paper pulp. In the Example, 15 kg/ton of 50 wt % aqueous aluminum sulfate solution was used as fixing agent, and dual retention aid (0.2 kg/ton of Nalco 61067 and 2.0 kg/ton of bentonite) was used as retention aid.

Comparative Example 5

GPAM copolymer solution 4 was used as only test additive in two dosages relative to the pulp slurry (1 kg/ton or 2 kg/ton or 4 kg/ton) to prepare comparative hand sheet samples 5a and 5b and 5c according to the hand sheet preparation method. The thick stock used in the Example was recycled waste paper pulp. In the Example, 15 kg/ton of 50 wt % aqueous aluminum sulfate solution was used as fixing agent, and dual retention aid (0.2 kg/ton of Nalco 61067 and 2.0 kg/ton of bentonite) was used as retention aid.

Comparative Example 6

Amphoteric Polyacrylamide Copolymer 2 was used as only test additive in two dosages relative to the pulp slurry (1 kg/ton or 2 kg/ton or 4 kg/ton) to prepare comparative hand sheet samples 6a and 6b and 6c according to the hand sheet preparation method. The thick stock used in the Example was recycled waste paper pulp. In the Example, 15 kg/ton of 50 wt % aqueous aluminum sulfate solution was used as fixing agent, and dual retention aid (0.4 kg/ton of Nalco 61067 and 2.0 kg/ton of bentonite) was used as retention aid.

According to the described methods, dry tensile index, burst index and temporary wet tensile index of the hand sheet samples were measured. The results are shown in the following Table 1:

TABLE 1

Dry tensile index, burst index and temporary wet strength index of the hand sheet samples

| Hand Sheet Sample | Dry Tensile Ind. (DTI) N · m/g | Increment % of DTI to blank | Burst Ind. (BI) kPa · $m^2$/g | Increment % of BI to blank | Temp. Wet Tensile Ind. (TWTI) N · m/g | Increment % of TWTI to blank |
|---|---|---|---|---|---|---|
| Pulp Slurry Batch 1 | | | | | | |
| 1A | 42.96 | 8.62% | 2.56 | 13.78% | 3.64 | 115.38% |
| 1B | 43.88 | 10.95% | 2.62 | 16.44% | 4.31 | 155.03% |
| 2A | 43.39 | 9.71% | 2.51 | 11.56% | 3.54 | 109.47% |
| 2B | 44.45 | 12.39% | 2.64 | 17.33% | 4.3 | 154.44% |
| 3A | 43.8 | 10.75% | 2.57 | 14.22% | 2.42 | 43.20% |
| 3B | 45.37 | 14.72% | 2.67 | 18.67% | 3.63 | 114.79% |
| 1a | 42.21 | 6.73% | 2.51 | 11.56% | 3.31 | 95.86% |
| 1b | 44.27 | 11.93% | 2.58 | 14.67% | 3.96 | 134.32% |
| 4a | 43.56 | 10.14% | 2.45 | 8.89% | 2.22 | 31.36% |
| 4b | 43.93 | 11.07% | 2.62 | 16.44% | 2.73 | 61.54% |
| BLANK | 39.55 | 0.00% | 2.25 | 0.00% | 1.69 | 0.00% |
| Pulp Slurry Batch 2 | | | | | | |
| 4A | 37.59 | 11.21% | 2.74 | 28.64% | 2.45 | 218.18% |
| 4B | 39.59 | 17.13% | 2.76 | 29.58% | 3.63 | 371.43% |
| 5A | 36.25 | 7.25% | 2.48 | 16.43% | 2.32 | 201.30% |
| 5B | 38.57 | 14.11% | 2.69 | 26.29% | 3.49 | 353.25% |
| 6A | 37.6 | 11.24% | 2.54 | 19.25% | 3.23 | 319.48% |

TABLE 1-continued

Dry tensile index, burst index and temporary wet strength index of the hand sheet samples

| Hand Sheet Sample | Dry Tensile Ind. (DTI) N · m/g | Increment % of DTI to blank | Burst Ind. (BI) kPa · $m^2$/g | Increment % of BI to blank | Temp. Wet Tensile Ind. (TWTI) N · m/g | Increment % of TWTI to blank |
|---|---|---|---|---|---|---|
| 6B | 39.86 | 17.93% | 2.79 | 30.99% | 5.02 | 551.95% |
| 7A | 35.86 | 6.09% | 2.57 | 20.66% | 2.64 | 242.86% |
| 7B | 38.44 | 13.73% | 2.69 | 26.29% | 4.21 | 446.75% |
| 2a | 36.85 | 9.02% | 2.41 | 13.15% | 2.66 | 245.45% |
| 2b | 37.37 | 10.56% | 2.64 | 23.94% | 3.61 | 368.83% |
| 3a | 37.46 | 10.83% | 2.54 | 19.25% | 3.33 | 332.47% |
| 3b | 38.58 | 14.14% | 2.74 | 28.64% | 5.11 | 563.64% |
| 4a | 37.58 | 11.18% | 2.37 | 11.27% | 1.2 | 55.84% |
| 4b | 39.39 | 16.54% | 2.63 | 23.47% | 1.74 | 125.97% |
| BLANK | 33.8 | 0.00% | 2.13 | 0.00% | 0.77 | 0.00% |
| Pulp Slurry Batch 3 | | | | | | |
| 8A | 44.39 | 2.47% | 2.82 | 25.33% | 2.18 | 28.99% |
| 8B | 46.73 | 7.87% | 3.19 | 41.78% | 3.04 | 79.88% |
| 8C | 50.51 | 16.60% | 3.43 | 52.44% | 4.01 | 137.28% |
| 5a | 46.1 | 6.42% | 2.97 | 32.00% | 1.99 | 17.75% |
| 5b | 45.2 | 4.34% | 3.25 | 44.44% | 2.69 | 59.17% |
| 5c | 48.38 | 11.68% | 3.47 | 54.22% | 4 | 136.69% |
| 6a | 44.13 | 1.87% | 2.97 | 32.00% | 1.93 | 14.20% |
| 6b | 46.1 | 6.42% | 3.31 | 47.11% | 1.98 | 17.16% |
| 6c | 47.25 | 9.07% | 3.34 | 48.44% | 2.37 | 40.24% |
| BLANK | 43.32 | 0.00% | 2.25 | 0.00% | 1.69 | 0.00% |

It can be seen from Table 1 that, as for Paper Slurry Batch 1, Sample 1A (using 3 kg/t of Combination 1) provides a wet strength increment of 115.38%, far more than the average value of the wet strength increments, i.e., 95.86% and 31.36%, provided by Samples 1a (only using 3 kg/t of GPAM copolymer solution 1) and 4a (only using 3 kg/t of Amphoteric Polyacrylamide Copolymer 1), respectively. Likewise, as for Pulp Slurry Batch 1, Sample 1B (using 6 kg/t of Combination 1) provides 155.03% of wet strength increment, which is also far more than the average value of the wet strength increments, i.e., 134.32% and 61.54%, provided by Samples 1b (only using 6 kg/t of GPAM copolymer solution 1) and 4b (only using 6 kg/t of Amphoteric Polyacrylamide Copolymer 1), respectively. As for Pulp Slurry Batch 2, Sample 4A (only using 3 kg/t of Combination 4) provides 218.18% of wet strength increment, far more than the average value of the wet strength increments, i.e., 245.45% and 55.84%, provided by Samples 2a (only using 3 kg/t of GPAM copolymer solution 2) and 4a (only using 3 kg/t of Amphoteric Polyacrylamide Copolymer 1), respectively. Likewise, as for Pulp Slurry Batch 2, Sample 4B (only using 6 kg/t of Combination 4) provides 371.43% of wet strength increment, which is also far more than the average value of the wet strength increments, i.e., 368.83% and 125.97%, provided by Samples 2b (only using 6 kg/t of GPAM copolymer solution 2) and 4b (only using 6 kg/t of Amphoteric Polyacrylamide Copolymer 1). Likewise, as for Pulp Slurry Batch 2, Sample 6A (using 3 kg/t of Combination 5) provides 319.48% of wet strength increment, far more than the average value of the wet strength increments, i.e., 332.47% and 55.84%, provided by Samples 3a (only using 3 kg/t of GPAM copolymer solution 3) and 4a (only using 3 kg/t of Amphoteric Polyacrylamide Copolymer 1). Likewise, as for Pulp Slurry Batch 2, Sample 6B (using 6 kg/t of Combination 5) provides 551.95% of wet strength increment, which is also far more than the average value of the wet strength increments, i.e., 563.64% and 125.97%, provided by Samples 3b (only using 6 kg/t of GPAM copolymer solution 3) and 4b (only using 6 kg/t of Amphoteric Polyacrylamide Copolymer 1). Likewise, As for Pulp Slurry Batch 3, Sample 8A (using 1 kg/t of Combination 6) provides 28.99% of wet strength increment, far more than the average value of the wet strength increments, i.e., 17.75% and 14.20%, provided by Samples 5a (only using 1 kg/t of GPAM copolymer solution 4) and 6a (only using 1 kg/t of Amphoteric Polyacrylamide Copolymer 2). Likewise, as for Pulp Slurry Batch 2, Sample 8B (using 2 kg/t of Combination 6) provides 79.88% of wet strength increment, which is also far more than Samples 5b (only using 2 kg/t of GPAM copolymer solution 4) and 6b (only using 2 kg/t of Amphoteric Polyacrylamide Copolymer 2). Likewise, as for Pulp Slurry Batch 2, Sample 8C (only using 4 kg/t of Combination 6) provides 137.28% of wet strength increment, which is also far more than the average value of the wet strength increments, i.e., 136.69% and 40.24%, provided by Samples 5c (only using 4 kg/t of GPAM copolymer solution 4) and 6c (only using 4 kg/t of Amphoteric Polyacrylamide Copolymer 2). This indicates that the composition according to the invention does not provide a simple addition effect in the paper-making process, but an interaction occurs.

Moreover, as for Pulp Slurry Batch 2, Samples 5A and 5B (using 3 kg/ton and 6 kg/ton of GPAM copolymer solution 2 in combination with 3 kg/ton and 6 kg/ton of Amphoteric Polyacrylamide Copolymer 1, and adding them separately into the paper slurry) provides wet strength increments of 201.30% and 353.25%, respectively, also far more than the average value of the wet strength increments provided by Samples 2a and 4a as well as the average value of the wet strength increments provided by Samples 2b and 4b; Samples 7A and 7B (using 3 kg/ton and 6 kg/ton of GPAM copolymer solution 3 in combination with 3 kg/ton and 6 kg/ton of Amphoteric Polyacrylamide Copolymer 1, and adding them into the paper slurry separately) provide wet strength increments of 242.86% and 446.75%, respectively, also far more than the average value of the wet strength increments provided by Samples 3a and 4a as well as the average value of the wet strength increments provided by Samples 3b and 4b. This indicates that, GPAMs and PAMs can produce the above interaction, even if in the paper slurry.

It should be noted that, the improvement of the paper properties (dry tensile strength, burst index or temporary wet tensile strength) does not increase proportionally to the dosage of the strengthening agent. For example, as for Pulp Slurry Batch 1, Sample 4b (only using 6 kg/t of Amphoteric Polyacrylamide Copolymer 1) adopts a strengthening agent dosage two times of Sample 4a (only using 3 kg/t of Amphoteric Polyacrylamide Copolymer 1), but Sample 4b shows a dry strength increment of 11.07%, which is far less than two times of the dry strength increment, 10.14%, of Sample 4a. Another example, as for Pulp Slurry Batch 1, Sample 1b (only using 6 kg/t of GPAM copolymer solution 1) adopts a strengthening agent dosage two times of Sample 1a (only using 3 kg/t of GPAM copolymer solution 1), but Sample 1b shows a wet strength increment of 134.32%, which is far less than two times of the wet strength increment, 95.86%, of Sample 1a. It can be seen that all the comparisons of the paper properties in the invention were performed based on the same total dosage of the strengthening agent.

It can be seen from Table 1 that, as for Pulp Slurry Batch 2, Samples 2a and 2b show the dry strength tensile increments (9.02%, 10.56%) and the burst index increment (13.15%, 23.94%), which are far less than the dry strength tensile increments (10.83%, 14.14%) and the burst index increment (19.25%, 28.64%) of Samples 3a and 3b, but Samples 4A and 4B show the dry strength tensile increments (11.21%, 17.13%) and the burst index increment (28.64%, 29.58%) which are equivalent to the dry strength tensile increments (11.24%, 17.93%) and the burst index increment (19.25%, 30.99%) of the hand sheet samples 6A and 6B. In the meanwhile, Samples 4A and 4B show a dry strength tensile increment an a burst index increment both larger than the average value of the dry strength tensile increments and the average value of the burst index increments of Samples 3a and 4a, respectively, as well as the average value of the dry strength tensile increments and the average value of the burst index increments of Samples 3b and 4b, which are in turn larger than the average value of the dry strength tensile increments and the average value of the burst index increments of Samples 2a and 4a, as well as the average value of the dry strength tensile increments and the average value of the burst index increments of Samples 2b and 4b. Samples 4A and 4B (Combination 4) adopt GPAM copolymer solution 2 (a polymer with a molecular weight of 200,000 Dalton), which can be stored at a normal temperature for about 2 to 3 months while Samples 6A and 6B (Combination 5) adopt GPAM copolymer solution 3 (a polymer of 800,000 Dalton), which can be stored at a normal temperature for about 10 days, far shorter than the shelf life of GPAM copolymer solution 2. It indicates that, the composition according to the invention provides not only an increase in temporary wet strength of paper but also an increase in dry strength of paper in the paper-making process. Moreover, when low molecular weight (weight average molecular weight of 100,000 to 300,000) of amphoteric or cationic or anionic dialdehyde-modified polyacrylamide-type strengthening agent is used in combination with the amphoteric polyacrylamide-type strengthening agent in the composition, the improvement in the dry strength of paper is maintained as that can be introduced by large molecular weight of the amphoteric or cationic or anionic dialdehyde-modified polyacrylamide-type strengthening agent while the shelf life is greatly improved.

Furthermore, the data of the temporary wet strength also indicates that the composition or the process of the invention has an excellent drainage effect for paper.

The aforementioned are merely exemplary embodiments of the invention, rather than limiting the scope of the invention which is determined by the appended claims.

The invention claimed is:

1. A process for paper-making comprising:

(a) adding to pulp slurry at least a first aqueous liquid and a second aqueous liquid so as to obtain a paper stock;

(b) forming the paper stock so as to obtain a wet paper web;

(c) pressing and draining the wet paper web so as to obtain a wet paper sheet; and (d) drying the wet paper sheet so as to obtain a paper sheet, wherein, the first aqueous liquid contains a dialdehyde-modified polyacrylamide-type strengthening agent and water, and the second aqueous liquid contains an amphoteric polyacrylamide-type strengthening agent and water;

the dialdehyde-modified polyacrylamide-type strengthening agent has a weight average molecular weight of 100,000-2,000,000 Dalton;

the amphoteric polyacrylamide-type strengthening agent has a weight average molecular weight of 100,000-10,000,000 Dalton; and the dialdehyde-modified polyacrylamide-type strengthening agent and the amphoteric polyacrylamide-type strengthening agent have a weight ratio of 25:75-75:25.

2. The process of claim 1, wherein the dialdehyde-modified polyacrylamide-type strengthening agent is a cationic dialdehyde-modified polyacrylamide-type strengthening agent, which is a dialdehyde-modified copolymer comprising acrylamide monomer and cationic monomer.

3. The process of claim 2, wherein the dialdehyde of the dialdehyde-modified copolymer is glyoxal.

4. The process of claim 2, wherein the cationic monomer is diallyldimethylammonium chloride.

5. The process of claim 2, wherein the acrylamide monomer is acrylamide.

6. The process of claim 1, wherein the dialdehyde-modified polyacrylamide-type strengthening agent has a weight average molecular weight of 100,000-300,000 Dalton.

7. The process of claim 1, wherein the amphoteric polyacrylamide-type strengthening agent is a copolymer comprising acrylamide monomer, cationic monomer and anionic monomer.

8. The process of claim 1, wherein the cationic monomer is selected from diallyldimethylammonium chloride, N-(3-dimethylaminopropyl)acrylamide, trimethyl-2-acroyloxyethylammonium chloride, 2-(dimethylamino)ethyl methacrylate, and combinations thereof.

9. The process of claim 7, wherein the anionic monomer is selected from acrylic acid, itaconic acid, salts thereof, and combinations thereof.

10. The process of claim 1, wherein the second aqueous liquid contains substantially 0% of aldehyde.

11. The process of claim 1, wherein the first aqueous liquid and the second aqueous liquid are mixed prior to the addition into the pulp slurry.

12. The process of claim 1, wherein the total amount of the first aqueous liquid and the second aqueous liquid added is 0.01-50 kg/ton dry fiber, based on the weight ratio of the total amount of the dialdehyde-modified polyacrylamide-type strengthening agent and the amphoteric polyacrylamide-type strengthening agent relative to the dry fiber in the pulp.

13. The process of claim 1, wherein the solid content of the dialdehyde-modified polyacrylamide-type strengthening agent in the first aqueous liquid is 0.01-50 wt %.

14. The process of claim 1, wherein the solid content of the amphoteric polyacrylamide-type strengthening agent in the second aqueous liquid is 0.01-50 wt %.

15. A composition for paper-making comprising one or more cationic or anionic or amphoteric dialdehyde-modified polyacrylamide-type strengthening agent and one or more amphoteric polyacrylamide-type strengthening agent;

wherein:

the dialdehyde-modified polyacrylamide-type strengthening agent has a weight average molecular weight of 100,000-2,000,000 Dalton;

the amphoteric polyacrylamide-type strengthening agent has a weight average molecular weight of 100,000-10,000,000 Dalton; and the dialdehyde-modified polyacrylamide-type strengthening agent and the amphoteric polyacrylamide-type strengthening agent added in the step (h) have a weight ratio of 25:75-75:25.

16. The composition of claim 15, wherein the dialdehyde-modified polyacrylamide-type, strengthening agent is a cationic dialdehyde-modified polyacrylamide-type strengthening agent, which is a dialdehyde modified copolymer comprising acrylamide monomer and cationic monomer.

17. The composition of claim 16, wherein the dialdehyde of the dialdehyde-modified copolymer is glyoxal.

18. The composition of claim 16, wherein the cationic monomer is diallyldimethylammonium chloride.

19. The composition of claim 16, wherein the acrylamide monomer is acrylamide.

20. The composition of claim 15, wherein the dialdehyde-modified polyacrylamide-type strengthening agent has a weight average molecular weight of 100,000-300,000 Dalton.

21. The composition of claim 15, wherein the amphoteric polyacrylamide-type strengthening agent is a copolymer comprising acrylamide monomer, cationic monomer and anionic monomer.

22. The composition of claim 21, wherein the cationic monomer is selected from diallyldimethylammonium chloride, N-(3-dimethylaminopropyl)acrylamide, trimethyl-2-acroyloxyethylammonium chloride, 2-(dimethylamino) ethyl methacrylate, and combinations thereof.

23. The composition of claim 21, wherein the anionic monomer is selected from acrylic acid, itaconic acid, salts thereof, and combinations thereof.

24. The composition of claim 21, wherein the composition contains substantially 0% aldehyde.

25. The composition of claim 15, wherein the total solid content of the dialdehyde-modified polyacrylamide-type strengthening agent and the amphoteric polyacrylamide-type strengthening agent in the aid composition for paper-making is 0.01-60 wt %.

26. The composition of claim 15, further comprising water.

* * * * *